United States Patent [19]

Watson

[11] 4,226,370

[45] Oct. 7, 1980

[54] SOIL PROCESSING DEVICE AND METHOD

[76] Inventor: Charles L. Watson, R.R. 7, Paris, Tex. 75460

[21] Appl. No.: 874,696

[22] Filed: Feb. 2, 1978

[51] Int. Cl.[3] ..... B02C 17/02; B02C 4/26

[52] U.S. Cl. ..... 241/30; 241/85; 241/93; 241/207; 241/280

[58] Field of Search ..... 241/85, 30, 93, 204, 241/207, 208, 280, 273.1, 273.2, 273.3

[56] References Cited

U.S. PATENT DOCUMENTS

| | | | |
|---|---|---|---|
| 8,893 | 6/1835 | Weaver | 241/273.3 X |
| 2,065,677 | 12/1936 | Fegley et al. | 241/204 |
| 2,208,335 | 7/1940 | Kurtz | 241/280 X |
| 2,271,175 | 1/1942 | Mcnelet | 241/93 X |
| 2,784,753 | 3/1957 | Kliem et al. | 241/280 X |
| 2,804,896 | 9/1957 | Silberberg | 241/280 X |
| 3,878,996 | 4/1975 | Dall'Argine et al. | 241/85 X |

*Primary Examiner*—Richard B. Lazarus
*Attorney, Agent, or Firm*—Richards, Harris & Medlock

[57] ABSTRACT

In a device and method for particulating conglomerated materials, and especially soil samples, a revolving drum is mounted for eccentric rotation about a vertical axis. A grating or screen comprises the cylindrical wall of the open ended drum. The materials to be worked are placed between the outer periphery of the drum and an arcuate wall mounted for pivotal movement with respect to the drum. The materials are then crowded by the movable wall into engagement with the grating of the revolving eccentric drum to break up the materials into particles of workable size. Hard matter, such as rocks or gravel, is segregated during the process. If desired, a row of fingers and/or a brush can be mounted for engagement with the drum to loosen accumulated materials from the drum during operation of the device.

10 Claims, 5 Drawing Figures

SOIL PROCESSING DEVICE AND METHOD

BACKGROUND AND SUMMARY OF THE INVENTION

The present invention relates generally to a device and method for breaking up encrusted materials. More particularly, the invention pertains to a novel device and method for uniformly particulating material such as a soil sample.

Frequently, materials which tend to conglomerate must be broken into particles of workable size before utilization. For example, chemicals, fertilizers, soil, and the like can form into dense, irregularly caked masses under conditions of high humidity and/or compression. Before such materials can be utilized, the conglomerations therein must be reduced to particles of the desired size. Various forms of sifting devices have heretofore been employed to accomplish this function. Of course, small clusters of relatively loosely packed materials can be broken up by hand. However, the sifting devices of the prior art are generally gravity fed and are thus incapable of breaking up clusters of tightly packed materials. As a consequence, the prior art approaches to this problem are characterized by waste and ineffectivity. There is thus a need for a device capable of conditioning even tightly packed conglomerations into particles of workable size.

For example, particulated soil is necessary for the various soil tests which must be conducted in the construction of earth works projects. Such earth works projects include foundations, embankments, roads, fills, dykes, levees, dams, and the like. Depending upon the size of the project, samples from one or more locations are taken so that the soil can be analyzed for moisture content, density, compaction, as well as other soil properties. Of course, uniform soil samples must be taken to obtain accurate test results. However, the problem of obtaining uniform soil samples is complicated by the fact that each sample is a distinct composition of sand, clay, minerals, and gravel or rock. Before testing, each soil sample must first be processed into particles or flakes of a uniform size, and any rock or gravel must be segregated therefrom. Uniform soil testing procedures have been established, one such procedure being the Rapid Method of Construction Control for Embankments of Cohesive Soil, as set forth in "Engineering monograph No. 26" printed by the U.S. Department of the Interior, Bureau of Reclamation. This testing procedure can be implemented by hand processing approximately twenty pounds of soil at field moisture through a No. 4 sieve, which is a difficult and time consuming process especially when CH or CL type material is involved. Heretofore there has not been available a mechanical apparatus for performing this function in accordance with such established requirements.

The present invention comprises a device and method for particulating materials which overcomes the foregoing and other difficulties long since associated with the prior art. In accordance with the broader aspects of the invention, a drum is provided with a cylindrical wall of screen or grating with a predetermined mesh size. The drum is preferably mounted for rotation about an axis offset from the longitudinal axis thereof. During rotation of the drum, the conglomerated materials are forced through the wall of the drum to reduce the materials to particles of the desired size. During the process, unbreakable matter is separated from the final particulated matter. The invention is particularly adapted for breaking up soil samples including hard, relatively large lumps of dense, tightly packed soil.

In accordance with more specific aspects of the invention, a drum is mounted for rotation about a substantially vertical axis offset from the longitudinal axis of the drum. The drum is adjustably secured between hubs to provide for variable eccentricity. A motor is employed to effect rotation of the drum through a chain and sprockets. The cylindrical wall of the rotating drum comprises a screen. An arcuate wall in positioned in spaced relationship to the periphery of the drum. The forward end of the arcuate wall is pivotally secured at a point adjacent to the rotating drum. The trailing end of the arcuate wall engages another wall and includes a lever arm connected to a weight. Preferably, the lever arm is extendible to provide the desired leverage forcing the arcuate wall toward the drum.

The material to be reduced is placed between the rotating drum and the arcuate wall, which then crowds the material into contact with the screen. A ratchet mechanism is utilized to prevent backlash of the arcuate wall as a consequence of the eccentricity of the rotating drum. The material is thus sheared as it is forced through the periphery of the drum to effect granulation. The workable particles of material are then collected beneath the drum for utilization. If desired, a row of fingers and/or a brush can also be mounted for engagement with the rotating drum to loosen any material clogged in the screen.

DESCRIPTION OF THE DRAWINGS

A more complete understanding of the invention can be had by reference to the following Detailed Description when taken in conjunction with the accompanying Drawings, wherein.

DETAILED DESCRIPTION

Figure 1:
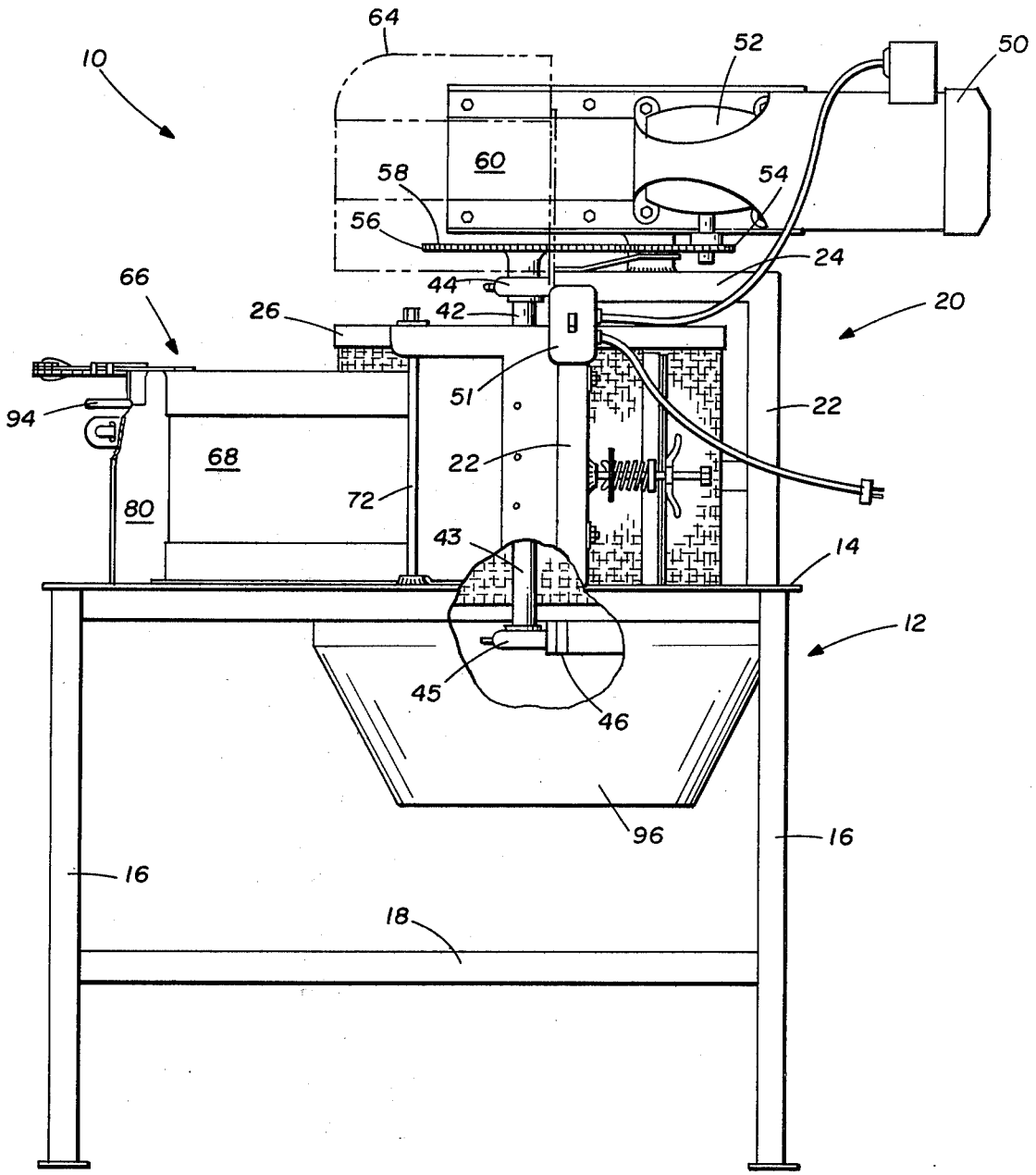
FIG. 1 is a side elevational view of a device incorporating the invention in which certain parts have been broken away to illustrate more clearly certain features of the invention.

Referring now to the Drawings, wherein like reference characters designate like or similar components throughout the several views, and particularly referring to FIG. 1, there is shown a device for particulating materials 10 incorporating the invention. Device 10 is particularly useful for breaking up conglomerated materials, such as soil and the like, into particles of workable size. By means of device 10, even dense and hardened clusters of materials can be quickly reduced to particles of the desired size. Device 10 is also characterized by rugged and uncomplicated construction.

Device 10 is mounted on a frame 12 comprising a substantially horizontal surface 14 supported by four legs 16, only two of which are shown. Cross braces 18, only one of which is shown, are preferably provided between legs 16 to stabilize frame 12. If desired, legs 16 and cross braces 18 can be fashioned from lengths of angle iron. Device 10 also includes subframe 20 rigidly secured to frame 12. In particular, subframe 20 comprises three upright members 22, only two of which are shown in FIG. 1, interconnected at the upper ends by cross members 24, only one of which is shown. it will thus be understood that frame 12 and subframe 20 comprise a rigid structure for supporting device 10.

Figure 5:
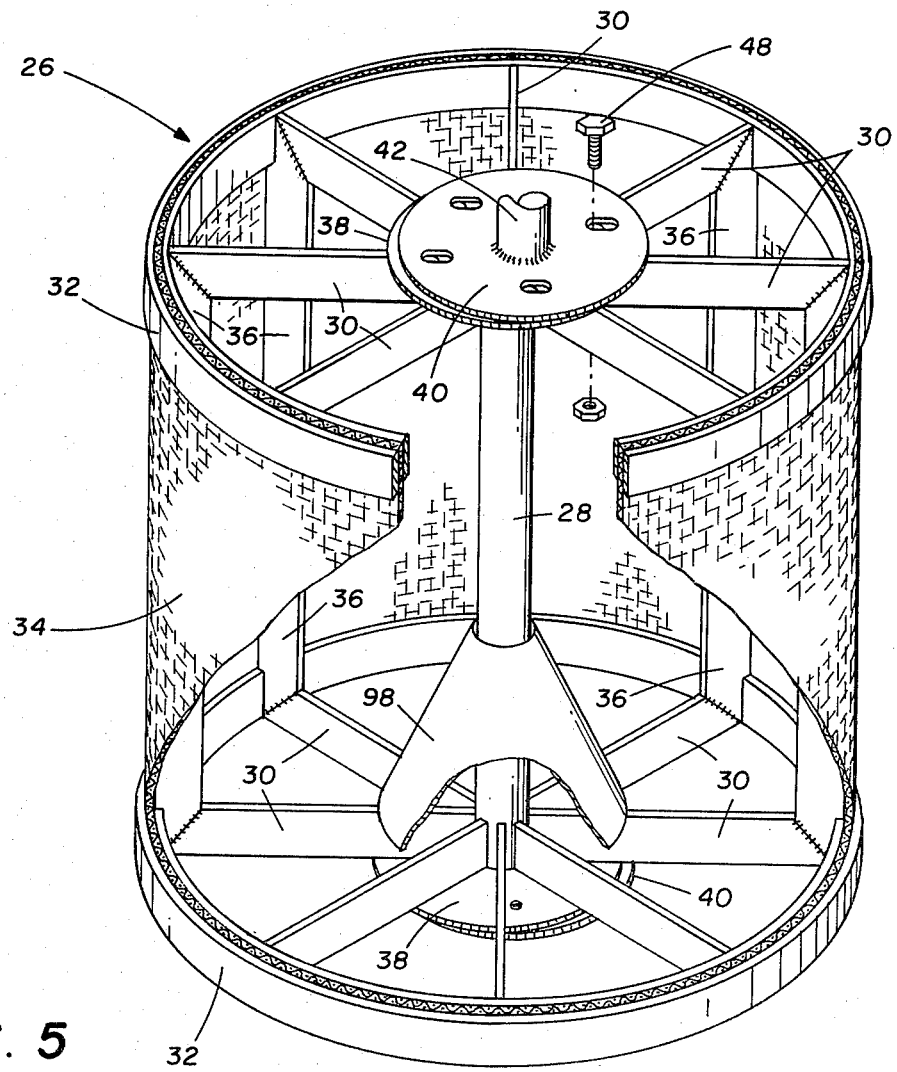
FIG. 5 is an enlarged perspective view of the rotating drum employed in the invention in which certain parts have been broken away to illustrate more clearly certain features of the invention.

With reference to FIG. 5 in conjunction with FIG. 1, there is shown a drum 26 which is mounted for rotation between subframe 20 and frame 12. The construction details of drum 26 are best shown in FIG. 5. Drum 26 includes a spindle 28 extending therethrough to define a central longitudinal axis. At the ends of spindle 28, a plurality of spokes 30 extend radially outwardly in parallel planes substantially perpendicular to the longitudinal axis of drum 26. Circular rims 32 surround the distal ends of each set of spokes 30 to define the upper and lower ends of drum 26. Grating or screen 34 of the desired mesh size extends between rims 32 to define the cylindrical wall of drum 26. Each rim 32 is preferably of annularized construction to securely fasten screen 34 along the edges thereof. In accordance with the preferred embodiment, a longitudinal brace 36 is mounted between each corresponding pair of spokes 30 to provide additional outward support for screen 34. Finally, a hub 38 is secured coaxially with spindle 28 to each end of drum 26. It will thus be understood that drum 26 comprises an open ended structure including a cylindrical wall portion defined by a screen or grating of predetermined mesh size.

Drum 26 is rotatably supported between frame 12 and subframe 20. Specifically, hubs 38 of drum 26 are secured between carrier hubs 40 which are mounted on shafts 42 and 43. The upper and lower pairs of hubs 38 and 40 have been omitted from FIG. 1 for clarity. Upper and lower shafts 42 and 43 are coaxial and are journaled for rotation in bearings 44 and 45, respectively. Lower bearing 45 is attached to supports 46 extending beneath the surface 14 of frame 12. Bearing 45 is preferably of the pillow block type. Upper bearing 44 mounted on subframe 20 rotatably supports upper shaft 42. As is best shown in FIG. 5, each carrier hub 40 includes a plurality of slots cooperating with holes in the corresponding hub 38, through which bolts 48 extend to fasten drum 26 between carrier hubs 40. Consequently, drum 26 is adjustably secured between hubs 40. It will thus be understood that drum 26 can be mounted for rotation about an axis coincidental with shafts 42 and 43, or about an axis offset therefrom. Device 10 functions most advantageously when drum 26 is mounted for eccentric rotation.

With further reference to FIG. 1, rotation of drum 26 is accomplished by a motor 50 which is connected to a suitable power source through switch 51. Motor 50 is connected to first drive sprocket 54 mounted on the output shaft of the speed reducer. Chain 56 connects sprocket 54 with second drive sprocket 58 on upper shaft 42.

Figure 2:
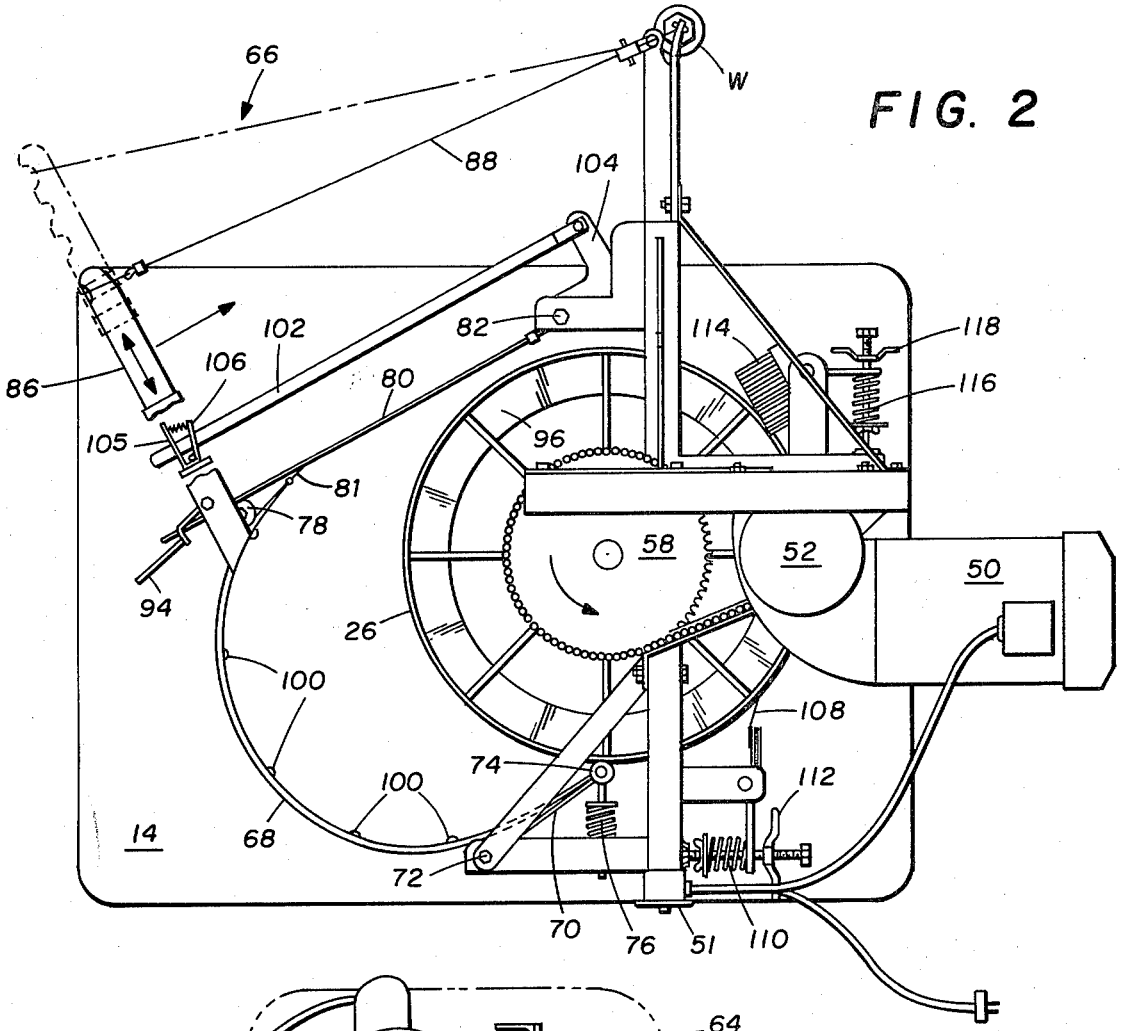
FIG. 2 is a top view of the device shown in FIG. 1.
Figure 4:
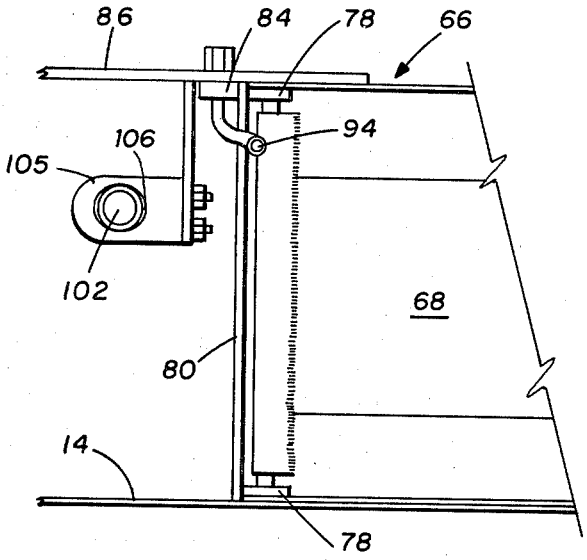
FIG. 4 is an enlarged illustration of a portion of the arcuate crowd wall.

Referring to FIG. 2 and FIG. 4, there is shown the crowd mechanism 66 which forces the material to be particulated into engagement with rotating drum 26, which preferably rotates counterclockwise as indicated by the arrow on sprocket 58 in FIG. 2. Mechanism 66 includes an arcuate wall 68 of semi-rigid construction which is mounted in spaced relationship with drum 26 and is substantially perpendicular to surface 14. The forward end of wall 68 is secured to a plate 70. One end of plate 70 is mounted for pivotal movement about pin 72, and a plurality of rollers 74 are provided along the opposite end of plate 70. Compression springs 76 maintain plate 70 in rolling engagement with the periphery of drum 26 to thereby seal off one end of the space between drum 26 and wall 68.

Figure 3:
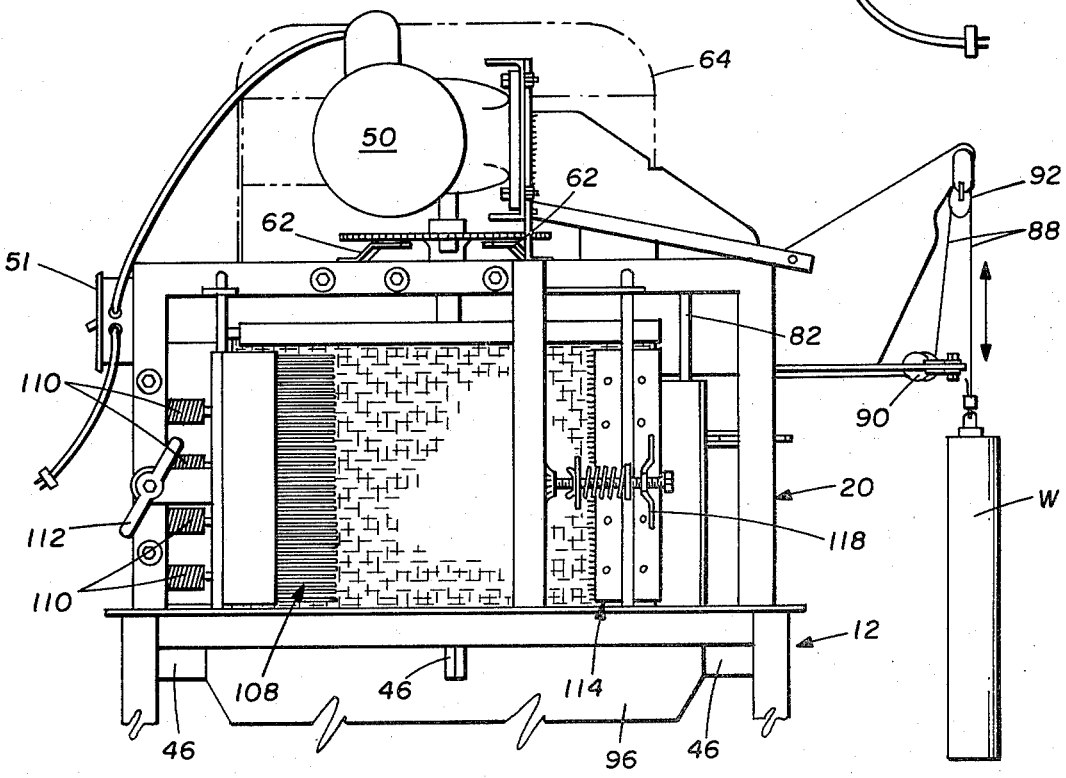
FIG. 3 is a partial end view of the device shown in FIG. 1.

The trailing end of arcuate wall 68 is mounted for movement relative to drum 26. A vertically spaced pair of rollers 78 are provided near the trailing end of wall 68 for rolling contact with straight wall 80. Preferably, resilient strip 81 is provided along the edge of the trailing end of wall 68 to seal the gap between wall 80. Substantially perpendicular to surface 14, wall 80 is pivotally connected at one end to pin 82. Straight wall 80 is guided between upper roller 78 and roller 84, which is secured to lever arm 86 extending outwardly from arcuate wall 68 as is best shown in FIG. 4. Weight W is connected through cable 88 to the end of arm 86 to provide leverage urging arcuate wall 68 toward drum 26. As is best shown in FIG. 3, cable 88 is guided by pulleys 90 and 92 secured to extensions of subframe 20. In accordance with the preferred construction, lever arm 86 is of extendible or telescoping sleeve construction as shown in phantom lines in FIG. 2 so that the leverage and thus the force exerted by arcuate wall 68 can be changed without requiring a change in weight W. The ability to vary the leverage on wall 68 comprises an important aspect of the invention.

When it is desired to break up a quantity of conglomerated material, the material is placed between wall 68 and drum 26. Motor 50 can be actuated to effect rotation of drum 26 either before or after placement of the material to be granulated. Handle 94 attached to arm 86 is lifted out of engagement with a notch in the upper edge of straight wall 80 to unlock walls 68 and 80. Mechanism 66 is thus released to crowd the relatively coarse material into engagement with revolving drum 26. As the coarse material is forced against screen 34, the material is sheared into particles of workable size which fall inside drum 26 and down through funnel 96 for collection and subsequent utilization. As is shown in FIG. 5, a cone shaped member 98 is preferably slidably disposed on spindle 28 of drum 26 to prevent paticulated material from collecting on lower hubs 38 and 40. If desired, a plurality of vertical ribs 100 can be provided on the inside surface of arcuate wall 68 to stabilize the coarse material during operation of device 10. Of course, any unbreakable materials such as rocks or gravel will not pass through screen 34 but will be segregated from the particulated material.

Crowd mechanism 66 functions as follows. As wall 68 moves toward drum 26, rod 102 secured at one end to bracket 104 is advanced through apertures in fixed plate 105 and hinged plate 106, which are biased apart. Plates 105 and 106 are attached to arm 86 to permit movement of wall 68 inwardly with respect to rod 102. Plate 105 is fixed with respect to arm 86, while plate 106 is biased to interfere with rod 102 in only one direction of relative movement therebetween. Outward movement of arcuate wall 68 is prevented by rod 102 becoming bound between plates 105 and 106. The eccentric rotation of drum 26 is thus prevented from causing outward movement of crowd mechanism 66 by this ratchet effect. Mechanism 66 is returned to the initial starting position shown in full lines in FIG. 2 by squeezing plates 105 and 106 together thereby releasing wall 68 for outward sliding movement on rod 102.

It will be understood that the operation of crowd mechanism 66 by which the coarse materials are maintained in positive, forcible engagement with rotating drum 26 comprises a significant feature of the present invention. By this means, hard and tightly caked masses can be quickly reduced to particles of workable size. Extendible lever arm 86 enables adjustment of the crowd force exerted by mechanism 66 without changing weight W.

Referring now to FIG. 3 together with FIG. 2, attachments to device 10 for cleaning screen 34 in drum 26 are shown. A row of resilient fingers 108 is positioned immediately beyond crowd mechanism 66 and adjacent to drum 26 for engagement with screen 34. Fingers 108 can be constructed of any suitable material, such as steel. Fingers 108 are pivotally biased into contact with screen 34 by compression springs 110. Adjustment of the force of engagement of fingers 108 is accomplished by rotating threaded knob 112. If desired, brush 114 can be utilized in place of or together with fingers 108. Brush 114 is located adjacent to drum 26 and preferably beyond fingers 108. Brush 114 is pivotally biased into engagement with screen 34 by spring 116. Adjustment of the force of engagement between brush 114 and screen 34 is accomplished by rotation of threaded knob 118. Incorporation of either one or both of these cleaning devices enhances the operation of device 10 by removing materials clogging the screen 34.

From the foregoing, it will be understood that the present invention comprises a device and method of particulating conglomerated materials which incorporates numerous advantages over the prior art. One significant advantage characterizing the invention involves the fact that hard, tightly packed masses of materials can be quickly and easily broken up into particles of workable size. This advantageous result is accomplished by forcibly crowding the material against a screen defining the cylindrical wall of a revolving drum, which is preferably mounted for eccentric rotation. Moreover, the crowd mechanism of the invention can be readily adjusted to provide for the hardness of various types of conglomerated materials. Any unbreakable matter in the material to be particulate is separated out during the process. Other advantages deriving from the use of the invention will readily suggest themselves to those skilled in the art.

Although particular embodiments of the invention have been illustrated in the accompanying Drawings and described in the preceding Detailed Description, it will be understood that the application is not limited to the embodiments disclosed, but is intended to embrace any alternatives, modifications, and rearrangements or substitutions of parts and elements as fall within the spirit and scope of the invention.

What is claimed is:

1. A method of reducing conglomerated of workable size, comprising the steps of:

providing a rotating drum having a wall portion formed of screen having a preselected mesh size;

providing a stationary surface adjacent to said drum;

providing on said surface an arcuate, substantially perpendicular wall moveable with respect to said drum;

placing the conglomerated material on said surface between the arcuate wall and the rotating drum; and forcefully advancing the arcuate wall toward the drum to crowd the material into positive engagement with the screen of the rotating drum thereby reducing the material into particles, and including the step of employing ratchet means between the arcuate wall and a fixed point for preventing outward displacement of said wall during operation.

2. A device for particulating conglomerated materials, which comprises:

a drum mounted for rotation about a substantially vertical axis;

means for effecting rotation of the drum;

said drum including a peripheral wall comprised of screen having a predetermined mesh size;

a substantially horizontal stationary surface positioned adjacent the drum;

an arcuate wall positioned in spaced relationship with the drum on said surface and mounted for movement relative to the drum; and means for selectively urging said arcuate wall toward the rotating drum to crowd conglomerated materials placed therebetween on the surface into engagement with said drum whereby said materials are sheared by the screen wall into particles, wherein the arcuate wall includes forward and trailing ends, and further including:

a first pivotally secured plate affixed to the forward end of the arcuate wall and in rolling contact with the periphery of the drum; and a second pivotally secured plate in rolling contact with the trailing end of the arcuate wall, said wall and first and second plates together with a peripheral portion of the drum defining the enclosure into which the materials to be particulated are placed.

3. The device according to claim 2 further including a plurality of substantially vertical ribs attached to the inside surface of the arcuate wall and having sufficient height to stabilize the conglomerated materials during crowding engagement with the drum.

4. The device according to claim 2 further including means for selectively interlocking the arcuate wall and the second plate.

5. A device for particulating conglomerated materials, which comprises:

a drum mounted for rotation about a substantially vertical axis;

means for effecting rotation of the drum;

said drum including a peripheral wall comprised of a screen having a predetermined mesh size;

a substantially horizontal stationary surface positioned adjacent to the drum;

an arcuate wall positioned in spaced relationship with the drum on said surface and mounted for movement relative to the drum; and means for selectively urging said arcuate wall toward the rotating drum to crowd conglomerated engagement with said drum whereby said materials are sheared by the screen wall into particles, wherein the arcuate wall includes forward and trailing ends, and wherein the means for selectively urging said arcuate wall toward the drum comprises:

a lever extending from a point near the trailing end of the arcuate wall; and a predetermined weight connected to the lever arm for creating a predetermined leverage on the arcuate wall for urging said arcuate wall toward the drum, and further including ratchet means connected between the lever arm and a fixed point adjacent to the drum for preventing displacement of the arcuate wall away from the drum during the crowding operation.

6. In a device for reducing conglomerated material into particles of workable size of the class wherein the conglomerated material is brought into contact with a screen or grating of predetermined mesh size to effect reduction, the improvement comprising:

a drum mounted for eccentric rotation about a substantially vertical axis;

said drum including a cylindrical wall comprised of the screen;

means for effecting rotation of the drum;

a stationary, substantially horizontal surface positioned adjacent the drum;

an upstanding arcuate wall slideable on said surface and positioned in spaced relationship to the drum;

said arcuate wall being secured at one end for pivotal movement relative to the drum;

a lever arm extending outwardly from the other end of the arcuate wall; and biasing means connected to the lever arm for leveraging the arcuate wall toward the drum to crowd conglomerated material placed therebetween on the stationary surface into positive engagement with the screen so that said material is reduced to particles.

7. A device for reducing conglomerated materials into particles of predetermined size, comprising:

a drum having a central axis and mounted for rotation about an axis offset from the axis of the drum;

said drum comprising a peripheral wall portion formed of screen with a preselected mesh size corresponding to the size of the desired particles;

means for effecting rotation of the drum;

a stationary surface located adjacent to the drum and substantially perpendicular to the axis of he drum;

an arcuate wall having formed and trailing ends and a bottom edge slidable on the stationary surface;

said arcuate wall being mounted in spaced relationship with the drum and pivotally secured at the forward end for movement relative to the drum;

said stationary surface and said arcuate wall together with a peripheral portion of the drum defining the enclosure into which the conglomerated materials are placed;

a lever arm extending outwardly from a point near the trailing end of the arcuate wall; and biasing means connected to the lever arm for urging said wall toward the drum to positively engage the conglomerated materials against the screen of said drum so that particles are sheared and deposited inside the drum.

8. The device of claim 7 wherein the lever arm is of telescoping construction so that the device can be adjusted to break up conglomerated materials of various hardnesses.

9. The device of claim 7 further including cleaning means positioned for engagement with the outer periphery of the drum for clearing clogged materials from the screen.

10. A device for reducing conglomerated materials into particles of predetermined size, comprising:

a drum having a central axis and mounted for rotation about an axis offset from the axis of the drum;

said drum comprising a peripheral wall portion formed of screen with a preselected mesh size corresponding to the size of the desired particles;

means for effecting rotation of the drum;

a stationary surface located adjacent to the drum and substantially perpendicular to the axis of the drum;

an arcuate wall having forward and trailing ends and a bottom edge slidable on the stationary surface;

said arcuate wall being mounted in spaced relationship with the drum and pivotally secured at the forward end for movement relative to the drum;

said stationary surface and said arcuate wall together with a peripheral portion of the drum defining the enclosure into which the conglomerated materials are placed;

a lever arm extending outwardly from a point near the trailing end of the arcuate wall; and means connected to the lever arm for urging said arcuate wall toward the drum to positively engage the conglomerated materials against the screen of said drum so that particles are sheared and deposited inside the drum, and further including ratchet means connected between the lever arm and fixed point adjacent to the drum for preventing outward displacement of the arcuate wall during eccentric rotation of the drum.

* * * * *